United States Patent [19]

Hitzman

[11] 4,113,017

[45] Sep. 12, 1978

[54] HOT EFFLUENT FROM PARTIAL OXIDATION OF NATURAL GAS INJECTED IN OIL RECOVERY PROCESS

[75] Inventor: Donald O. Hitzman, Bartlesville, Okla.

[73] Assignee: Phillips Petroleum Company, Bartlesville, Okla.

[21] Appl. No.: 749,196

[22] Filed: Dec. 9, 1976

[51] Int. Cl.[2] ..... E21B 43/24

[52] U.S. Cl. ..... 166/303; 166/57; 166/272; 166/309

[58] Field of Search ..... 166/303, 272, 57, 59, 166/256–259, 309

[56] References Cited

U.S. PATENT DOCUMENTS

| | | | |
|---|---|---|---|
| 2,186,688 | 1/1940 | Walker | 260/451 |
| 2,734,578 | 2/1956 | Walter | 166/272 |
| 2,754,098 | 7/1956 | Heinze | 166/303 X |
| 3,150,716 | 9/1964 | Strelzoff et al. | 166/272 |
| 3,216,498 | 11/1965 | Palm | 166/59 X |
| 3,358,762 | 12/1967 | Closmann | 166/303 |
| 3,595,316 | 7/1971 | Myrick | 166/303 |
| 3,980,137 | 9/1976 | Gray | 166/303 |
| 3,993,135 | 11/1976 | Sperry et al. | 166/57 X |

*Primary Examiner*—Stephen J. Novosad

[57] ABSTRACT

Natural gas is subjected to partial oxidation with the hot effluent from the oxidation injected into an underground formation to provide hot contact fluid, solvent liquids, and drive force for recovering oil from the formation. In one embodiment liquid product, including methanol, is recovered from the hot oxidation effluent before injection of the effluent into the underground formation.

3 Claims, 1 Drawing Figure

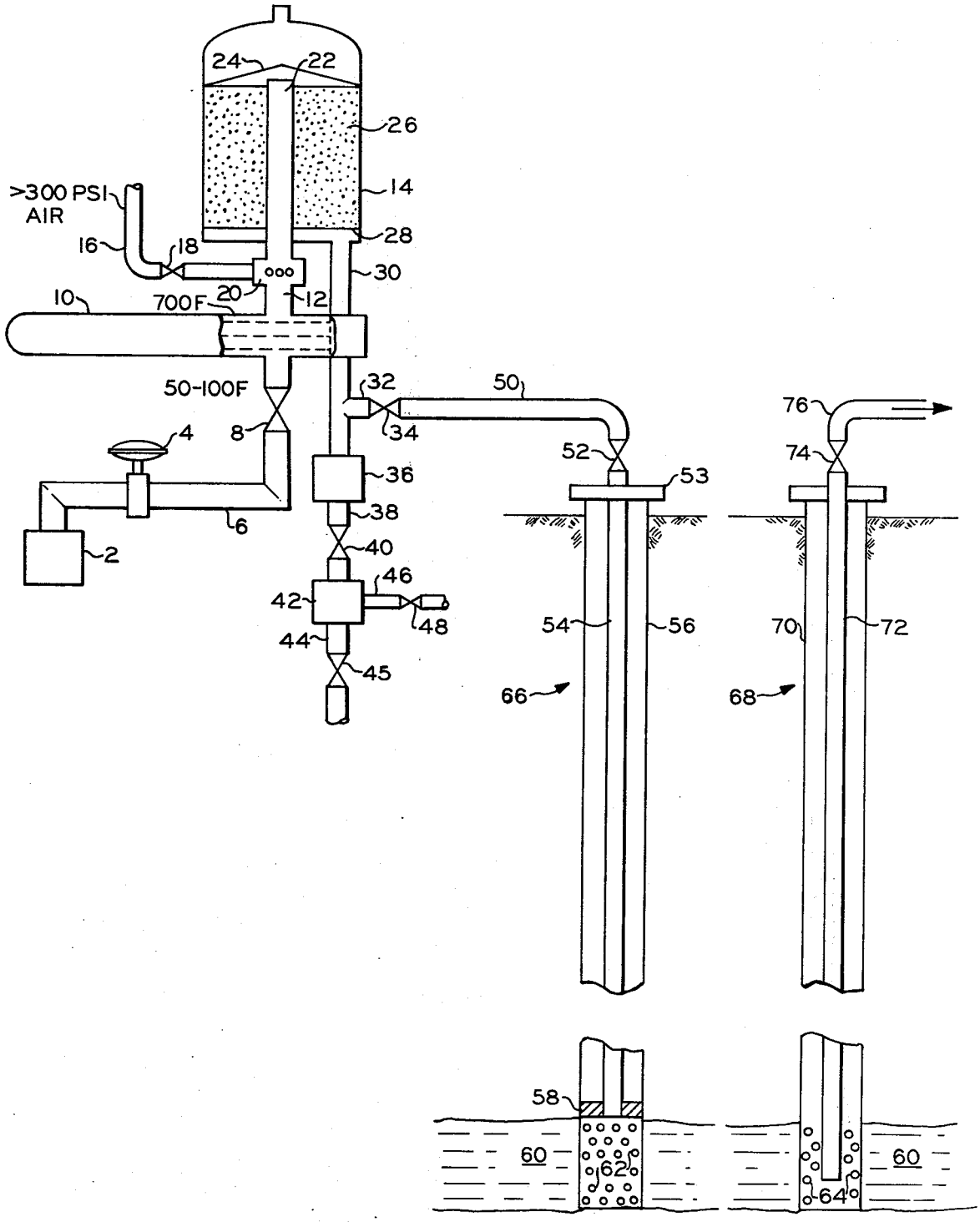
24
22
26
14
>300 PSI
AIR
16
18
28
30
10
700F
20
12
50-100F
32
50
34
4
8
76
74
52
53
36
38
6
2
40
46
42
48
44
45
54
56
70
72
66
68
58
60
62
60
64

HOT EFFLUENT FROM PARTIAL OXIDATION OF NATURAL GAS INJECTED IN OIL RECOVERY PROCESS

BACKGROUND OF THE INVENTION

This invention relates generally to the recovery of oil from underground, oil-bearing formations. In one of its aspects this invention relates to the treatment of underground formations with hot gases and solvents to recover oil from the formations. In another of its aspects this invention relates to the production of partial oxidation products in the oxidation of natural gas on the site in petroleum production fields. In another of its aspects this invention relates to the partial oxidation of natural gas to produce hot gases, liquid solvent, and driving force for treatment of an underground formation.

The injection into an underground formation of exhaust gases, whether the exhaust gases are natural gas as recovered or natural gas that has been heated, is well known in the art. A method for increasing the volume of the natural gas for use in underground formation treatment adds increased value to the use of natural gas as a treating means. The addition of solvent materials to the treating medium again increases the value of natural gas as an underground formation treatment medium. By the process of this invention natural gas is converted into a treatment medium for underground formations which has both an increased volume over what could be obtained by simply heating natural gas and contains liquid solvents which aid in the recovery of oil from underground formations. The treatment medium of increased volume and containing solvent compounds can be produced from natural gas available in the field being subjected to treatment without the sometimes, expensive transportation of solvent materials to the well site for addition to the treatment medium.

It is therefore an object of this invention to provide a method for recovering oil from an underground formation. It is another object of this invention to provide a treatment medium for underground formations, producing the treatment medium on site from available natural gas. It is still another object of this invention to increase the usefulness of natural gas as a treatment medium for underground formations by providing means for converting the natural gas into a product of increased volume and containing liquids that can act as solvents for petroleum products in underground formations.

Other aspects, objects, and the various advantages of this invention will become apparent upon study of this specification, the drawing, and the appended claims.

STATEMENT OF THE INVENTION

According to this invention a method for recovering oil from an underground formation is provided in which hot combustion products from the partial oxidation of natural gas are injected into an oil-bearing, underground formation. In an embodiment of the invention natural gas is subjected to partial oxidation and the hot effluent from the reaction is passed directly into an underground formation. In another embodiment of the invention natural gas is subjected to a partial oxidation reaction and the hot effluent from the reaction is treated at least partially to remove liquid product from the effluent before the remainder of the effluent is injected into the underground formation.

The invention is applicable for use of natural gas as it is found in most of the world and is particularly applicable to naturally produced and processed gases containing a high methane content, i.e., methane content over about 90 percent, which can lead to the production of a partial oxidation effluent containing a relatively large amount of methanol using a partial oxidation process such as that set out in U.S. Pat. No. 2,186,688.

The partial oxidation product can be produced by field units located on the site in production fields where natural gas is available or can be made available economically. The partial oxidation products can be used as an injection medium in any of the well-known processes for treatment of underground formations with gases or liquid solvents to produce oil retained in the formation. Partial oxidation products find use only in the standard treatment methods, but also in such processes as the so called "huff-puff" process which uses a surfactant which foams to produce plugging in the more permeable zones of the treated formation as is described in U.S. Pat. No. 3,412,793.

The invention is best described using an exemplary situation in conjunction with the drawing. The drawing illustrates diagrammatically an embodiment of the apparatus employed in carrying out the process of the invention.

Referring now to the drawing, natural gas of approximate composition of methane, 94.2 mole percent; ethane, 3.2 mole percent; propane, 2.1 mole percent; and butane and heavier, 0.5 mole percent; is conducted from a source such as gas under pressure from a producing well or gas plant through meter 2 from which the gas is passed through a pressure-regulating device 4 into pipe 6 at a substantially constant pressure of about 300 psi. The gas is conducted through valve connection 8 and a regular flow rate into the outer phase of the cold end of a heat exchanger 10. The temperature of the gas at this point is normally in the range of 50–100° F (10°–37.8° C). In passing through the heat exchanger 10 the gas is preheated to a temperature of approximately 700°–750° F (371°–399° C) by indirect contact with hot treated gas from the process. From the heat exchanger, the gas is discharged into pipe 12, the inlet connection to the reaction vessel 14. Simultaneously, air or oxygen, in measured volume and under a pressure of about 300 psi, is introduced into pipe 12 from air pipe 16 through valve 18 and mixing device 20. Mixing device 20 has a plurality of very small orifice openings from pipe 16 into a Venturi throat of pipe 12 whereby small, high velocity jets of air are introduced into pipe 12 at right angles to the direction of hot gas flowing therethrough so that a thorough and rapid mixing of hydrocarbon gas and air is effected. This mixture of hot gas and air, preferably containing less than 10 percent by volume of oxygen, is introduced through riser 22 into the top of the reaction vessel 14 and is released into an annular reaction space below cone 24. Below cone 24 the space 26 is preferably filled with catalyst. The catalyst used is a mixture of aluminum phosphate and copper oxide deposited on pumice. Since satisfactory yields of the product are obtainable without the use of any catalysts or contact filling in the reactor chamber, the invention is not limited to the use of catalysts or contact substances. The reaction progresses more smoothly and is much more easily controlled, however, when a contact material or filling is employed in the reaction chamber 14. The preferred filling consists of a pumice base having deposited thereon approximately 3.1 pounds of aluminum phosphate and approximately one-half pound of copper oxide per cubic foot of catalyst mass. This catalyst is of the mixed type, the aluminum phosphate being considered an excellent dehydration catalyst, while the copper oxide is a well-known catalyst generally considered to favor oxidation. In place of the preferred catalyst other metals and non-metals and their oxides may be used, either singly or in combination. A mixture of an oxide of a metal of the first or second groups of the periodic table, such as copper, zinc or silver oxide, with phosphorus acid salt or oxide of a metal of group 3, such as aluminum or thallium phosphate or oxide, in the relative proportions present in the preferred catalyst makes a satisfactory contact substance. The mixture of gases flows downward through catalyst 26 which is supported above a space at the bottom of the reactor chamber by grid 28.

For treating hydrocarbon gas of the type forming the subject of this example, the amount of air introduced through nozzles into pipe 12 is preferably controlled to maintain the maximum temperature in the reaction zone in 14 in the range of 800°–900° F (427°–482° C). This temperature is maintained in the broad range of about 550° F (288° C) to about 1000° F (538° C). The control of the temperature is effected through the amount of oxygen or air added to make up the reaction mixture, and through the degree of preheat which is imparted to the reaction mixture. Gas entering the reaction zone is normally preheated to a temperature within the approximate range of 400°–1000° F (204°–538° C). Air or oxygen is usually added to the reaction mixture in the proportions of 8–10 percent by volume of oxygen per volume of hydrocarbon or gas under treatment. The temperature is maintained in the reaction zone by heat resulting from exothermic reactions between the hydrocarbon and oxygen and is dependent not only on the nature and amounts of the reacting constituents but also on the character of the reaction vessel and the rapidity with which the heat is removed from the reaction vessel by radiation and as sensible heat carried out of the reactor by the products of the reaction. The outlet to the reaction vessel 14 is through pipe 30 located below supporting grid 28.

From pipe 30 the hot reaction mixture, containing liquid hydrocarbonoxygen products formed in the reaction zone in vapor form, passes through heat exchanger 10 wherein the products are cooled to a temperature of about 250°–400° F (121°–204° C) by indirect heat exchange with the hydrocarbon on its way to the reaction chamber. Some of the liquid hydrocarbon-oxygen product condenses in the heat exchanger, and for this reason the heat exchanger and connections leading from the discharge side of its inner phase are preferably constructed of corrosive-resistant material, such as brass, and are arranged to facilitate rapid draining off and collecting of condensed liquids through outlet pipe 32. If it is desired that the condensed vapors be separated from the reaction gases, the reaction gases and condensed vapors can be passed from the cold end of the heat exchanger 10 through a downward pipe 32 into a water condenser 36. The condenser is preferably constructed of brass or other relatively non-corrosive metal. Water at ambient temperature passes through the condenser 36 by inlet and outlet means not shown. The products of the reaction are cooled to a temperature of approximately 90° F (32.2° C) by indirect heat transfer from the water, and the liquid hydrocarbon-oxygen condensate is recovered in separator 42 by passing through pipe 38 and valve 40. Separator 42 may be equipped with internal helically arranged baffles (not shown) whereby whirling cyclone motion is imparted to the gas with the liquid particles are thrown to the outside and collected in the bottom of the separator. The liquid products exit through pipe 44 and valve 45. The gases exit through pipe 46 and valve 48. The description immediately above represents the method of separating and separately recovering the gas and liquid products from this partial oxidation process.

The partial oxidation treatment of natural gas of the aforementioned composition with about 10 percent by volume of air at the pressures and temperatures indicated yields a liquid hydrocarbon-oxygen product of the following approximate composition: acetaldehyde — 5 to 6 percent by weight, methanol — 34 to 36 percent by weight, formaldehyde — 20 to 23 percent by weight, together with varying amounts of water and higher alcohols, aldehydes, acetols, esters, ketones and other hydrocarbon-oxygen compounds. The product distribution of the different materials is dependent largely on inlet temperature, pressures within the reaction vessel, and duration time within the reaction vessel. Reaction conditions usually are controlled to produce a tail gas having approximately the following composition in mole percent: methane 83.5 percent, ethane 3.0 percent, propane 2.0 percent, butane 0.4 percent, carbon monoxide 1.7 percent, hydrogen 0.2 percent, and nitrogen 9.2 percent. The yield of liquids is approximately 2.5 gals/M cu. ft. of fresh hydrocarbon natural gas. Further details of the process can be found in U.S. Pat. No. 2,186,688.

In the present invention the condenser and separator preferably are not used. Instead, the cooled hydrocarbon-oxygen products of the oxygenation process pass through pipe 32, valve 34, pipe 50, going to a wellhead 53 where they are injected directly into an injection well through valve 52. Since the pressures required for injecting gases into wells depend on existing formation pressures, the hydrocarbon-oxygen products may pass through mechanical means for increasing pressure such as a pump or turbine blower (not shown) in order to raise the pressure of the stream to a level above the existing formation pressures. The effluent pressure existing in pipe 50, in most cases, is sufficient to inject the products into shallow wells 1000–2000 feet in depth. Well 66 is an injection well lined with casing 56 and injection tube 54. The hot oxygenation reaction products at a temperature of 250°–400° F (121°–204° C) enter well tubing 54 through valve 52 and pass through packer 58 at the bottom of the well 66. The liquid and gaseous products at this temperature flow through perforations 62 into oil formation 60 in a hot gas injection process wherein the hot hydrocarbon-oxygen products are used to drive the oil and gas in formation 60 into production well 68. Production well 68 has casing 70 and producing tubing 72. Produced hydrocarbons flow through perforations 64 in casing 70 into producing tubing 72 and out valve 74 and pipe 76 at the surface for storage and/or passage into a products pipeline. Hydrocarbons produced through pipe 76 normally comprise both gas and liquid and require separation at the surface in a separator (not shown) wherein the liquid hydrocarbons are recovered for delivery to a tank with gases delivered to a products pipeline. In cases where the gas pressure in well 68 is not sufficient to bring the produced hydrocarbons to the surface, a conventional oil well pump may be used in the well.

As described, the system represents a direct, hot gas drive in which the gas, aside from being of increased volume by passing through the hot reaction, contains partial oxidation liquid products, such as methanol which is soluble in both oil and water. The methanol and other oxidation products act as aids in releasing hydrocarbons from the rock pores of the formation.

This invention can also be used in the "huff-puff" process described in U.S. Pat. No. 3,412,793 in which a single injection-production well is used. The hot gas and liquids are injected for a period of 10–20 days, the well allowed to soak for a period of 3–5 days, after which it is put on production. Surfactants may be injected at the wellhead into the hot gases and liquids to create a foam downhole which plugs the more permeable sections, thereby directing the hot gases and liquids into oil-bearing sections of the formation.

In the process of this invention, recovery of all, or part, of the liquids can be carried out in separator 42 with the gases exiting from valve 48 into inlet pipe 50.

I claim:

1. A method for recovering oil from an underground formation comprising injecting into said formation combustion products containing both gas and liquid from partial oxidation of natural gas said combustion products at a temperature in the range of about 250° to about 400° F thereby providing hot gases, liquid solvent, and driving force for treatment of said underground formation.

2. A method of claim 1 wherein liquid products from said partial oxidation of natural gas are partially removed from said hot combustion products before injection of the hot combustion products into said underground formation.

3. A method of claim 1 wherein the pressure of said hot combustion products is increased by mechanical means so that said pressure is sufficient for injection of the hot combustion products into said underground formation.

* * * * *